United States Patent [19]

Schenk

[11] 4,113,663

[45] Sep. 12, 1978

[54] 2-ETHYL-6,6-DIMETHYL-2-CYCLOHEXENE-1-CARBOXYLIC ACID ETHYL ESTER PERFUME COMPOSITIONS

[75] Inventor: Hanspeter Schenk, Zumikon, Switzerland

[73] Assignee: Givaudan Corporation, Clifton, N.J.

[21] Appl. No.: 729,521

[22] Filed: Oct. 4, 1976

[30] Foreign Application Priority Data

| | | | |
|---|---|---|---|
| Oct. 9, 1975 | [CH] | Switzerland | 13117/75 |
| Jul. 27, 1976 | [CH] | Switzerland | 9584/76 |
| Sep. 23, 1976 | [CH] | Switzerland | 12073/76 |

[51] Int. Cl.[2] ..... C11B 9/00

[52] U.S. Cl. ..... 252/522; 560/128; 560/205

[58] Field of Search ..... 252/522; 260/468 L, 260/468 R

[56] References Cited

U.S. PATENT DOCUMENTS 4,006,108 2/1977 Ochsner et al. ..... 252/522

OTHER PUBLICATIONS

Chem. Ab. 84:44470s, 1976 (Ger. Offen. 2,508,060, Sept. 4, 1975, Brit. Appl. Feb. 22, 1974).

*Primary Examiner*—Veronica O'Keefe
*Attorney, Agent, or Firm*—Thomas Cifelli, Jr.; Robert F. Tavares

[57] ABSTRACT

The 2-ethyl-6,6-dimethyl-2-cyclohexene-1-carboxylic acid ethyl ester possesses uniquely-desirable olfactory properties.

4 Claims, No Drawings

2-ETHYL-6,6-DIMETHYL-2-CYCLOHEXENE-1-CARBOXYLIC ACID ETHYL ESTER PERFUME COMPOSITIONS

FIELD OF THE INVENTION

This invention relates to the field of olfactory, i.e., perfume, products.

SUMMARY OF THE INVENTION

The present invention relates to a novel odorant. More particularly, the invention is concerned with odorant compositions containing 2-ethyl-6,6-dimethyl-2-cyclohexene-1-carboxylic acid ethyl ester of the formula

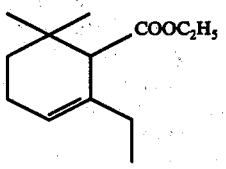

(I)

and a process for the manufacture of compound(I). The invention is also concerned with a method of imparting an odour to materials using said ester or said compositions.

DESCRIPTION OF THE PREFERRED EMBODIMENTS

According to the process provided by the present invention, the ester of formula I is manufactured by (a) cyclising 3-ethyl-7-methyl-2,6-octadienoic acid ethyl ester, or (b) esterifying 2-ethyl-6,6-dimethyl-2-cyclohexene-1-carboxylic acid.

The manufacture of the ester of formula I according to embodiment (a) or (b) of the process can be carried out by known methods for the synthesis of cyclogeranoyl derivatives. The syntheses are illustrated in the following Formula Scheme:

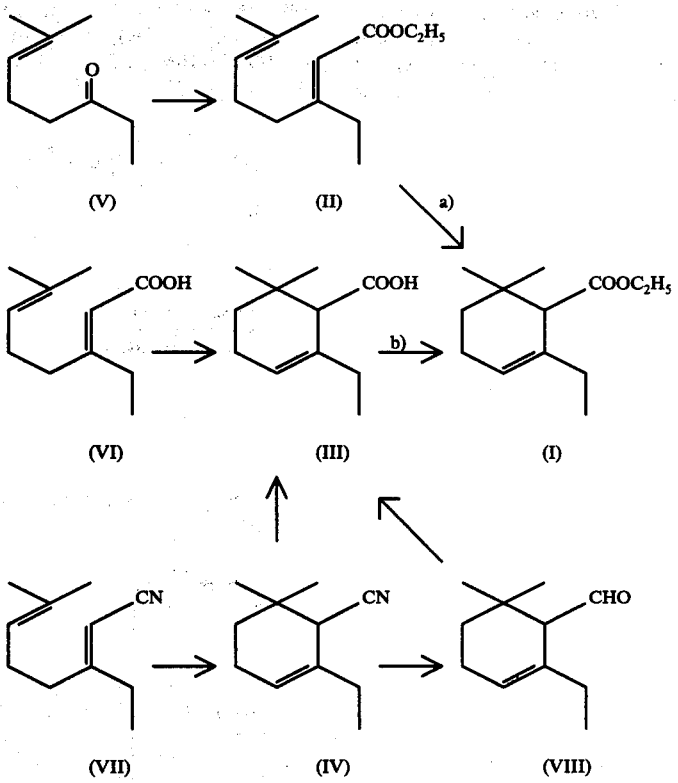

The cyclisation of the ester of formula II can be carried out according to methods which are known per se. Suitable cyclising agents are inorganic and organic protonic acids (e.g. sulphuric acid, phosphoric acid, methanesulphonic acid, formic acid, acetic acid etc) or Lewis acids (e.g. boron trifluoride, stannic chloride, zinc chloride etc).

The cyclisation can be carried out in the presence or absence of solvent. Suitable solvents are inert solvents (e.g. hexane, benzene, nitromethane etc). The temperature is not critical and the cyclisation can be carried out at room temperature or at a higher or lower temperature.

The ester of formula II is appropriately prepared from the ketone of formula V. This preparation is carried out, for example, by the Horner-Wittig reaction (Wadsworth-/Emmons-Modification, J. Amer. Chem. Soc. 83, 1733, [1961]), the ketone being reacted with a carbalkoxymethylenediethyl phosphonate in the presence of an alkali metal hydride or alkali metal alcoholate as the base.

The reaction is appropriately carried out in an aprotic solvent (e.g. benzene, toluene, dimethoxyethane etc). The reaction temperature is not critical. The reaction is preferably carried out at a temperature from about 40°–60° C, but a lower or higher temperature is possible.

However, the ester of formula II can also be prepared by reacting the ketone of formula V with bromoacetic acid ester/zinc by the Reformatzky reaction and eliminating water from the hydroxy-ester which is initially formed. Here, the reaction is appropriately carried out in an inert solvent (e.g. diethyl ether, benzene, toluene etc). The elimination of water from the hydroxy-ester is preferably carried out using phosphorus tribromide in pyridine (Shriner, Organic Reactions, 1, 1 [1947]).

The esterification of the acid of formula III is appropriately carried out by treating one of its acid salts (e.g. an alkali metal salt) with an ethyl halide (e.g. ethyl iodide) in alcohol (see, for example, Houben-Weyl, Methoden der organischen Chemie VIII (Methods of organic chemistry), 541 [1952]). The temperature at which the esterification is carried out is not critical, but it is appropriately carried out at room temperature.

The acid of formula III is prepared from the acid of formula VI or from the nitrile of formula VII, if necessary via the aldehyde of formula VIII. The cyclisation of the acid of formula VI can be carried out as indicated hereinbefore for the cyclisation of the ester of formula II. The cyclisation of the nitrile of formula VII can be carried out in the same manner. The cyclic nitrile of formula IV can be saponified by methods which are known per se (e.g. under alkaline conditions) to give the acid of formula III. The cyclic nitrile of formula IV can, however, also be converted into the aldehyde of formula VIII, for example by reduction with diisobutylaluminium hydride (Miller et al, J. Org. Chem. 24, 627 [1959]). The reduction is appropriately carried out in an inert solvent (e.g. hexane or toluene) and preferably at room temperature. The resulting aldehyde of formula VIII is then appropriately oxidised to the acid of formula III using silver nitrate/hydroxide solution (see, for example, Walborsky et al, J. Amer. Chem. Soc. 73, 2593 [1951]). The oxidation is appropriately carried out in an alcohol/water mixture and at room temperature.

The ester of formula I has particular odorant properties. Thus it provides, for example, an extremely diffuse rose note of very remarkable radiance which is accompanied by honey-like, warm-spicy and fruity berry-like side-notes. The woody, lightly flowery base note with fruity berry-like side-notes reminiscent of dry fruits is also worthy of mention.

The ester of formula I, which can be manufactured easily and cheaply, provides odorant properties which come quite close to the highly sought but expensive damascone of formula IX and accordingly can serve as a cheap substitute for damascone. This is surprising since none of the compounds having a closely related structure to the ester of formula I (e.g. compounds of formulae X-XIII) provide the corresponding odorant properties.

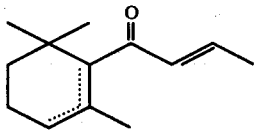

(IX)
flowery (rose-like) woody, slightly powdery, remarkable radiance

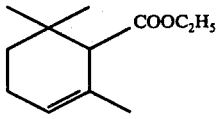

(X)
camphorous, woody, very dry, flat, medical side-note

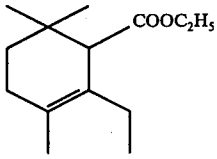

(XI)
agreste [rustic] [reminiscent of eucalyptus seeds], slightly woody and peppery-spicy, somewhat fruity, similar to tobacco

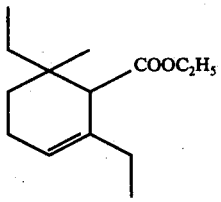

(XII)
woody, dry, tangy, slightly sweet

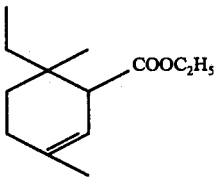

(XIIII)
camphorous (less pronounced than the compound of formula X), woody, weak Accordingly, because of its interesting olfactory properties, the ester of formula I can be used as an odorant; for example, in perfumery for the production of odorant compositions such as perfumes or for perfuming products of all types such as soaps, washing agents, solid and liquid detergents, aerosols or other cosmetic products (e.g. creams, cleansing milk, make-up, lipsticks, bath salts, bath oils etc).

Because of its very natural notes, the ester of formula I is particularly suitable for modifying known compositions (e.g. those of a flowery type and in particular those having rose bases). Its organoleptic character enhances, above all, base notes (e.g. chypre). It is very well suited in combination with wood notes (e.g. those from p-tert-.butylcyclohexyl acetate, sandalwood oil, patchouli oil, cedryl acetate and methyl ionone).

Depending on the intended use, the concentration of the ester of formula I can vary within wide limits; for example, between about 1 wt.% in the case of detergents and about 15 wt.% in the case of alcoholic solutions. In perfume bases or concentrates the concentrations can of course also be higher.

It will accordingly be appreciated that the invention includes within its scope (a) an odorant composition which contains as an essential odour-imparting ingredient 2-ethyl-6,6-dimethyl-2-cyclohexene-1-carboxylic acid ethyl ester and (b) a method of imparting an odour to materials, which method comprises applying to said materials or incorporating therein an odour-imparting amount of 2-ethyl-6,6-dimethyl-2-cyclohexene-1-carboxylic acid ethyl ester or of an odorant composition as hereinbefore set forth. It will be understood by those skilled in the field of perfumery that the novel ester of this invention is desirably used in olfactory or fragrance compositions in an olfactorily-effective amount and along with at least one other desirable olfactory agent.

The following Examples illustrate the present invention. Example 1 illustrates the process and Example 2 illustrates a typical odorant composition.

EXAMPLE 1

30 g (0.143 mol) of c,t-3-ethyl-7-methyl-2,6-octadienoic acid ethyl ester are carefully added to a solution, cooled to 5°–10° C, of 280 ml of concentrated formic acid and 20 ml of concentrated sulphuric acid. After the dropwise addition is complete, the mixture is allowed to attain room temperature. It is then further stirred at this temperature for 1 hour. The mixture is poured on to ice and extracted three times with hexane. The combined hexane solutions are washed once with water, twice with sodium bicarbonate solution and once again with water, dried over sodium sulphate and evaporated. The crude product (27.5 g) is fractionally distilled. There are obtained 21 g (70%) of pure 2-ethyl-6,6-dimethyl-2-cyclo-hexene-1-carboxylic acid ethyl ester of boiling point 102°–103° C/11mm Hg; $n_D^{20}$ = 1.4615.

The c,t-3-ethyl-7-methyl-2,6-octadienoic acid ethyl ester used as the starting material can be prepared as follows:

A solution of 5.8 g (0.25 g-atom) of sodium in 130 ml of absolute ethanol is placed in a four-necked flask which is fitted with a mechanical stirrer, a dropping funnel, a reflux condenser and a thermometer. A solution of 30 g (0.214 mol) of 7-methyl-6-octen-3-one and 62.5 g (0.279 mol) of carbethoxymethylenediethyl phosphonate in 130 ml of absolute toluene is added dropwise to this at 0°–10° C over a period of 0.75 hour. The mixture is subsequently allowed to attain room temperature and is further stirred at this temperature for two hours. The mixture is poured on to ice-water and extracted three times with hexane. The combined hexane solutions are washed three times with water, dried over sodium sulphate and evaporated.

The crude product (41 g) is fractionally distilled. At 55°–56° C/0.02 mm Hg, there are obtained 29.3 g (65.1%) of pure c,t-3-ethyl-7-methyl-2,6-octadienoic acid ethyl ester.

Example 2

| Composition (green base) | Parts by weight |
|---|---|
| Verbena absolute | 10 |
| Wormwood oil | 10 |
| Mastic absolute | 20 |
| Basil oil | 80 |
| Methyl dihydrojasmonate | 100 |
| Alcohol 95° | 130 |
| Linalyl acetate synthetic | 200 |
| α-Hexylcinnamaldehyde | 200 |
| Benzyl salicylate | 200 |
| | 950 |

When 50 parts by weight of 2-ethyl-6,6-dimethyl-2-cyclohexene-1-carboxylic acid ethyl ester are added to the foregoing green base, a very efficacious rounding-off of the composition is realised. The resulting composition now has a fuller and more intensive effect and the sharp character of the original base is displaced in an advantageous manner in the direction of flowery-green. The verbena note now fits in harmoniously in the complex wormwood-mastic, and the latter is ideally bound with the linalyl acetate head-note.

Example 3

| Composition (with rose character) | Parts by weight |
|---|---|
| 3,5-Dimethyl-cyclohex-3-ene-carboxaldehyde, 10% in propylene glycol | 2 |
| Decanal, 10% in propylene glycol | 3 |
| Geranyl acetate | 5 |
| Alpha-ionone | 10 |
| 1,1-Dimethyl-4-acetyl-6-tert. butylindane | 10 |
| Cinnamic alcohol synth. | 50 |
| Citronellol extra | 100 |
| Geraniol extra | 200 |
| Phenyl ethyl alcohol extra | 500 |
| | 880 |

When 120 parts by weight of ethyl 2-ethyl-6,6-dimethyl-2-cyclohexene-1-carboxylate are added to the foregoing base which has a rose character, then the special note of tea roses becomes more pronounced. The resulting composition is fresher and more natural.

Example 4

| Composition (Eau-de-Cologne type) | Parts by weight |
|---|---|
| Indol, 10% in propylene glycol | 10 |
| Coumarin | 10 |
| Ylang-Ylang Oil | 20 |
| Neroli Oil | 40 |
| Lavandin Oil | 40 |
| Benzyl acetate | 40 |
| Eugenol extra | 40 |
| Citral | 60 |
| Methyl dihydrojasmonate | 100 |
| Alpha-hexyl cinnamic aldehyde | 100 |
| Lemon Oil, ital. | 100 |
| Bergamot Oil | 360 |
| | 920 |

When 80 parts by weight of ethyl 2-ethyl-6,6-dimethyl-2-cyclohexene-1-carboxylate are added to the foregoing Eau-de-Cologne type base, the common citrus note is changed in an unexpected manner. Addition of the ester balances the sharpness as a result of the combination with the lavandincoumarin complex whose odour is thus complex, emphasised giving more body and sweetness to the composition.

Example 5

| Composition (with fruity character) | Parts by weight |
|---|---|
| Osmanthus absolute | 5 |
| Ethylene brassylate | 10 |
| Gamma-undecalactone | 15 |
| Palmarosa Oil | 20 |
| 2-Ethoxycarboxymethyl-2-methyl-1,3-dioxolane | 30 |
| Allyl ionone | 40 |
| Dimethyl benzyl carbinyl butyrate | 50 |
| Alpha-ionone | 80 |
| Propylene glycol | 700 |
| | 950 |

When 50 parts by weight of ethyl 2-ethyl-6,6-dimethyl-2-cyclohexene-1-carboxylate are added to the foregoing fruity base, the resulting composition is much more diffusive and rounded. It is more natural and the velvet apricot note is especially good.

Example 6

| Composition (Chypre type) | Parts by weight |
|---|---|
| Methyl nonyl acetaldehyde 10% in propylene glycol | 5 |
| n-Dodecanal 10% in propylene glycol | 5 |
| Eugenol extra | 10 |
| Versalide ® (Givaudan) | 30 |
| Methyl phenyl carbinyl acetate | 30 |
| Terpeneol | 30 |
| Methylionone | 40 |

Example 6-continued

| Composition (Chypre type) | Parts by weight |
|---|---|
| | 50 |
| Linalool extra | 50 |
| Benzyl acetate | 50 |
| Bornyl acetate liqu. | 50 |
| Bergamot Oil | 150 |
| Alpha-hexyl cinnamic aldehyde | 225 |
| 1-Methylcyclodecyl methyl ether | 225 |
| | 950 |

When 50 parts by weight of ethyl 2-ethyl-6,6-dimethyl-2-cyclohexene-1-carboxylate are added to the foregoing Chypre type vase, the pronounced and therefore unpleasant phenolic and smoky notes are unespectlly suppressed. The ester plends hamonious with the composition giving more freshness and readiation to the composition.

Example 7

| Composition (woody type) | Parts by weight |
|---|---|
| Basil Oil | 30 |
| Methyl ionone | 50 |
| p-tert. Butylcyclohexyl acetate | 50 |
| Methyl dihydrojusmonate | 70 |
| Cedryl acetate crist. | 100 |
| Sandalwood Oil east indian | 200 |
| Patchouli Oil | 200 |

Example 7-continued

| Composition (woody type) | Parts by weight |
|---|---|
| Bergamot Oil | 200 |
| | 900 |

When 100 parts by weight of ethyl 2-ethyl-6,6-dimethyl-2-cyclohexene-1-carboxylate are added to the foregoing woody base, the odor of the composition changes to a more herbaceous, tart one, well suited for "men's lines". Strengthened diffusion is also observed.

We claim:

1. A perfume composition which contains an olfactorily-effective amount of damascone-like 2-ethyl-6,6-dimethyl-2-cyclohexene-1-carboxylic acid ethyl ester and at least one other olfactory agent.

2. A method of producing a perfume composition in accordance with claim 1 which method comprises combining olfactorily-effective amount of damascone-like 2-ethyl-6,6-dimethyl-2-cyclohexene-1-carboxylic acid ethyl ester and at least one other olfactory agent.

3. A perfume composition in accordance with claim 1 wherein said perfume composition is selected from the group consisting of cologne and perfume.

4. A method in accordance with claim 2 wherein said composition is selected from the group consisting of cologne and perfume.

* * * * *